US006918356B2

(12) United States Patent
Rowe et al.

(10) Patent No.: US 6,918,356 B2
(45) Date of Patent: Jul. 19, 2005

(54) METHOD AND APPARATUS FOR OPTIMIZING A STEAM BOILER SYSTEM

(75) Inventors: Michael Alan Rowe, Bridgewater, NJ (US); John Philip Goetsch, Orange, MA (US)

(73) Assignee: Intelliburn Energy Systems, Monte Sereno, CA (US)

( * ) Notice: Subject to any disclaimer, the term of this patent is extended or adjusted under 35 U.S.C. 154(b) by 53 days.

(21) Appl. No.: 10/652,824

(22) Filed: Aug. 29, 2003

(65) Prior Publication Data

US 2005/0045117 A1 Mar. 3, 2005

(51) Int. Cl.[7] ..... F22B 37/38
(52) U.S. Cl. ..... 122/448.1; 122/446; 236/20 R
(58) Field of Search ..... 122/448.1, 448.2, 122/446, 451.1, 451.2; 236/20 R, 15 BG

(56) References Cited

U.S. PATENT DOCUMENTS

| | | | | | |
|---|---|---|---|---|---|
| 3,042,007 | A | | 7/1962 | Chien et al. | |
| 3,510,635 | A | * | 5/1970 | Rouxel et al. | 700/35 |
| 3,545,207 | A | * | 12/1970 | Jenkins, Jr. et al. | 60/652 |
| 4,064,698 | A | * | 12/1977 | Stern | 60/664 |
| 4,457,266 | A | | 7/1984 | La Spisa | |
| 4,497,283 | A | | 2/1985 | LaSpisa et al. | |
| 4,653,276 | A | * | 3/1987 | Sugano et al. | 60/665 |
| 5,279,263 | A | * | 1/1994 | Cameau et al. | 122/480 |
| 5,739,504 | A | | 4/1998 | Lyons et al. | |
| 6,390,027 | B1 | * | 5/2002 | Lyons et al. | 122/14.2 |
| 6,520,122 | B2 | | 2/2003 | Kemp et al. | |

* cited by examiner

*Primary Examiner*—Gregory Wilson
(74) *Attorney, Agent, or Firm*—Robert C. Brown

(57) ABSTRACT

A method for controlling a steam boiler or oil heater for maximum fuel efficiency by systematically finding the most fuel-efficient combination of input control values. A characteristic multi-dimensional look-up table is created by temporarily operating the process at all the possible functional combined settings of a plurality of input operators and recording for each combination of settings the resulting output values of a plurality of process parameters, for example, steam flow, steam pressure, and exhaust composition. Input combinations resulting in either non-functional process or unacceptable output values are eliminated. Steam flow rate is the primary output control parameter. A selected value of steam flow rate is the primary control setpoint for the process. If several combinations of input values can cause the process to meet the primary control setpoint, the combination using the minimum fuel flow is selected as optimal. If the desired setpoint does not correspond exactly to discrete input values in the table, the correct input settings may be inferred by interpolation. Valves and dampers are dynamically controlled by output drive signals in an improved closed-loop control, using a function of the process output value and time to recalculate and adjust the drive signals.

18 Claims, 4 Drawing Sheets

METHOD AND APPARATUS FOR OPTIMIZING A STEAM BOILER SYSTEM

TECHNICAL FIELD

The present invention relates to boilers and oil heaters having single or dual burners fueled by gaseous (e.g. natural gas or landfill gas) or liquid (e.g. oil) fuel, or a combination thereof; more particularly, to methods and apparatus for optimizing the burning of fuel in such boilers and oil heaters; and most particularly, to methods and apparatus for controlling a steam boiler or oil heater for maximum fuel efficiency by systematically finding the most fuel-efficient combination of input control values and then controlling around those values to meet a primary process output setpoint.

BACKGROUND OF THE INVENTION

Boilers for generating steam from water are well known, the steam being used typically for motivating steam engines or steam turbines, for heating, for cooling, for cleaning and sterilizing, and for many other known uses. Oil heaters for providing hot oil as an energy transfer medium are likewise well known. (As used herein, the term "boiler" should be taken to mean boiler or oil heater, and, except where noted, the invention as described for boilers should be understood as being also applicable to oil heaters.) Such boilers are known to be fueled by a variety of energy sources, for example, nuclear decay and hydrocarbon combustion. Some typical hydrocarbon fuel sources are wood, coal, fuel oil, and natural gas.

A particular class of boiler systems employs an injectable hydrocarbon fluid fuel, such as fuel oil or natural gas, which may be readily supplied under pressure to a boiler via a pipeline, and which may be readily metered via a fuel control valve to a burner disposed within the boiler. Fuel oil injection may be assisted by an auxiliary steam injector. Typically, the fuel is injected axially at a first end of a generally cylindrical or rectangular, elongated firing chamber. A high-capacity blower, or air pump, introduces combustion air via an air flow control valve, or damper, into the firing chamber in the region of the injector, and fuel and air flow axially of the firing chamber. Ignition is initiated by an independent pilot light system to produce an elongate burner flame. The air flow typically is divided into at least a primary flow introduced axially of the flame and a secondary flow introduced peripherally of the flame, whereby the rate of burn and shape of flame may be modified. The firing chamber is generally surrounded by, and in contact with, an array of water-conveying boiler tubes continually supplied with water. Heat from combustion is transferred by conduction, convection, and radiation through the walls of the firing chamber and the tubes to heat and ultimately boil the water, producing steam. The steam generated is collected at a boiler drum and is conveyed to points of use via a steam header. The cooled flame gases are exhausted, typically to the atmosphere, via a stack.

In some prior art boiler systems, the fuel control valve and air control valve are linked via either mechanical or electrical means such that the fuel and air flows vary together in an apparently fixed ratio, which ratio is determined experientially to produce an "acceptable" flame. An acceptable flame is one that produces both the required volume of steam and an environmentally acceptable exhaust, without particular regard to the fuel efficiency of the flame in producing the steam. The ratio, however, is not truly fixed, since the actuation functions of a typical valve and damper are not linear.

In some prior art boiler systems, there typically is no means for optimizing various process parameters to produce the most steam for the least fuel. For example, there is no means for systematically optimizing the total air flow or the air-to-fuel ratio: too much air can result in excess heated air in the exhaust, which is wasteful; too little air can result in sub-optimal combustion, coking of the boiler tubes, and hydrocarbon residues in the exhaust. Further, improper primary and secondary air control, as well as improper total air control and fuel control, can result in a) highly localized combustion in relatively short regions along the length of the firing chamber, which combustion thereby under-utilizes a substantial portion of the total heat-exchanging surface area, and b) a chaotic and unstable flame which only partially adheres to the walls of the firing chamber, thereby permitting a substantial portion of the flame to pass through the system without making contact with a heat-transfer surface.

Further, in the prior art, the process controller operates from the beginning at start-up by feedback control from random positions of the control operators, making iterative changes to each input setting as the controller recognizes that the designated process control output parameter value still does not match the setpoint value. The controller has no a priori "knowledge" of what the ultimately correct settings will be, and thus such settings are essentially experimentally re-determined every time the process is started up. Further, the controller has no predetermined means for optimizing the overall process by mutually optimizing the setting of each input operator. Thus, although the output value eventually matches the setpoint, by definition placing the process in control, it is highly unlikely that the combination of settings which is optimum for fuel efficiency has been determined. For example, in firing a steam boiler to achieve a setpoint value for steam flow and/or steam pressure, there may be literally thousands of combinations of settings and conditions for fuel flow, primary air flow, secondary air flow, trim air flow, total air flow, and flue gas recirculation flow which will cause the system to provide proper steam flow at the proper pressure. However, only one or at most a very few of such combinations include the minimum fuel flow. The prior art controller has no means of determining what that combination is, and therefore has no means for moving the process towards it.

Further, some prior art boiler control schemes utilize proportional-integral-differential (PID) logic for controlling fuel and/or air flow to the burner, which can result in substantial overshoot and cycling of the process during startup and at other points of significant process instability.

Further, some prior art boiler control systems are extremely difficult, time-consuming, and costly to troubleshoot to determine the cause of a process failure.

What is needed is a method and apparatus for controlling the generation of steam by a fluid-fueled steam boiler system, wherein at least the flow of fuel, the flow of primary air, and the flow of secondary air are independently and optimally controlled to generate a given flow of steam at a given manifold pressure and a stack exhaust meeting environmental quality standards, while using a minimum flow rate of fuel.

What is further needed is a control logic that brings a steam boiler system into process control rapidly and minimizes process overshoot and cycling at start-up of the process.

What is further needed is a steam boiler process control system that can identify immediately causes of process failures.

It is a principal object of the present invention to minimize the fuel cost of operating a steam boiler system.

It is a further object of the present invention to increase the reliability and therefore extend the runtime of a steam boiler system.

It is a still further object of the present invention to provide easy trouble-shooting of process anomalies and failures in operation of a steam boiler system.

It is a still further object of the invention to bring a steam boiler system into steady-state control rapidly and with minimum process cycling.

SUMMARY OF THE INVENTION

Briefly described is a method for controlling a steam boiler system in accordance with the invention.

Before placing the system in production operation, the independent process input variables, for example, fuel flow rate, primary air flow rate, and secondary air flow rate, are identified. Acceptability ranges are specified for each process output parameter, for example, steam pressure, steam temperature, flue CO, flue $O_2$, etc. Then, the process is characterized by generating a characteristic multi-dimensional matrix or look-up table of the input and output values wherein the process is operated stepwise at all the possible factorial combinations of process input control variable settings, and the resulting process output values of all the relevant process output parameters are recorded. Non-functional combinations are eliminated from the table.

At process start-up, a desired value of a primary output parameter, for example, steam flow, is selected. Then, an optimum or near-optimum combination of input settings is selected from the table, which combination has been shown to provide approximately the desired process output value, which combination also results in acceptable results for all other output parameters, and which combination also uses the minimum fuel flow rate.

In a two-step approach to control, first, all input control operators are set initially at the optimum table-selected input values, rather than beginning at random settings as in the prior art. Second, a feedback control system takes over dynamic control of the input operators beginning at those settings which are very nearly the settings required for steady-state operation, resulting in a rapid and controlled adjustment to steady-state conditions with minimal control overshoot.

This two-step approach to achieving steady-state process control is an important improvement over the prior art approach, since at start-up of a boiler system the control input settings and output parameters are far from their steady-state values.

In addition, actuation of the individual valves and dampers preferably is calibrated in two important ways representing improvement over the prior art.

First, from relationships determined in generating the look-up table, each mechanism is calibrated for linear response with respect to the controller such that a given percentage increment in control output signal results in the same percentage increment in flow through the mechanism. This is a very important improvement, as most regulating devices in common use, such as butterfly valves and dampers, are highly non-linear in flow vs. actuation position.

Second, because each valve and damper actuator system has a characteristic response speed, the drive signals sent to each such system are adjusted and coordinated so that all of the control devices move at the same percent speed, thus maintaining as constant the ratios of flows during control transitions.

BRIEF DESCRIPTION OF THE DRAWINGS

These and other features and advantages of the invention will be more fully understood and appreciated from the following description of certain exemplary embodiments of the invention taken together with the accompanying drawings, in which.

DESCRIPTION OF THE PREFERRED EMBODIMENTS

Figure 1:
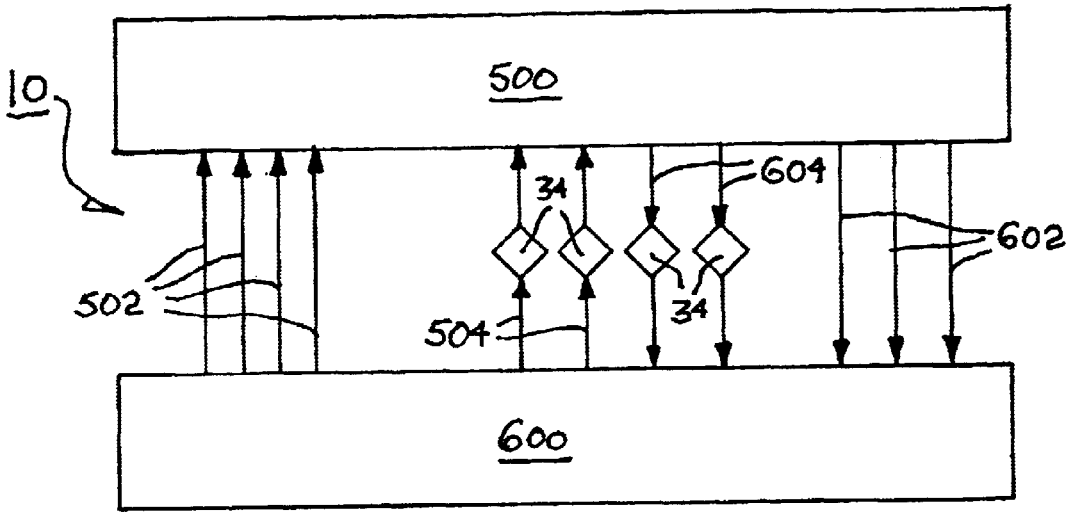
FIG. 1 is a simplified schematic flow diagram showing the relationship between a process operating system and a process control system.

FIG. 1 is offered to make clear the relationships among the main elements involved in the invention and the nomenclature describing such relationships. Referring to FIG. 1, a schematically-shown process 10 includes a process control system (PCS) 500, preferably comprising a computer CPU or a high-capacity programmable controller, and a process operating system (POS) 600 comprising a plurality of control operators or mechanisms, such as valves, dampers, switches, transducers, and the like. Status signals 502 may be sent directly from elements in POS 600, or may be sent 504 via an intermediate Burner Management System (BMS) 34, shown here and in FIGS. 2*a*, 2*b*, 2*c* as diamond shapes in the flow logic but actually a part of PCS 500. Similarly, control signals 602 may be sent directly from PCS 500 to POS 600, or may be sent 604 via intermediate BMS 34. It should be understood that, as used herein, process outputs are also computer inputs, and computer outputs are process inputs.

Figure 2A:
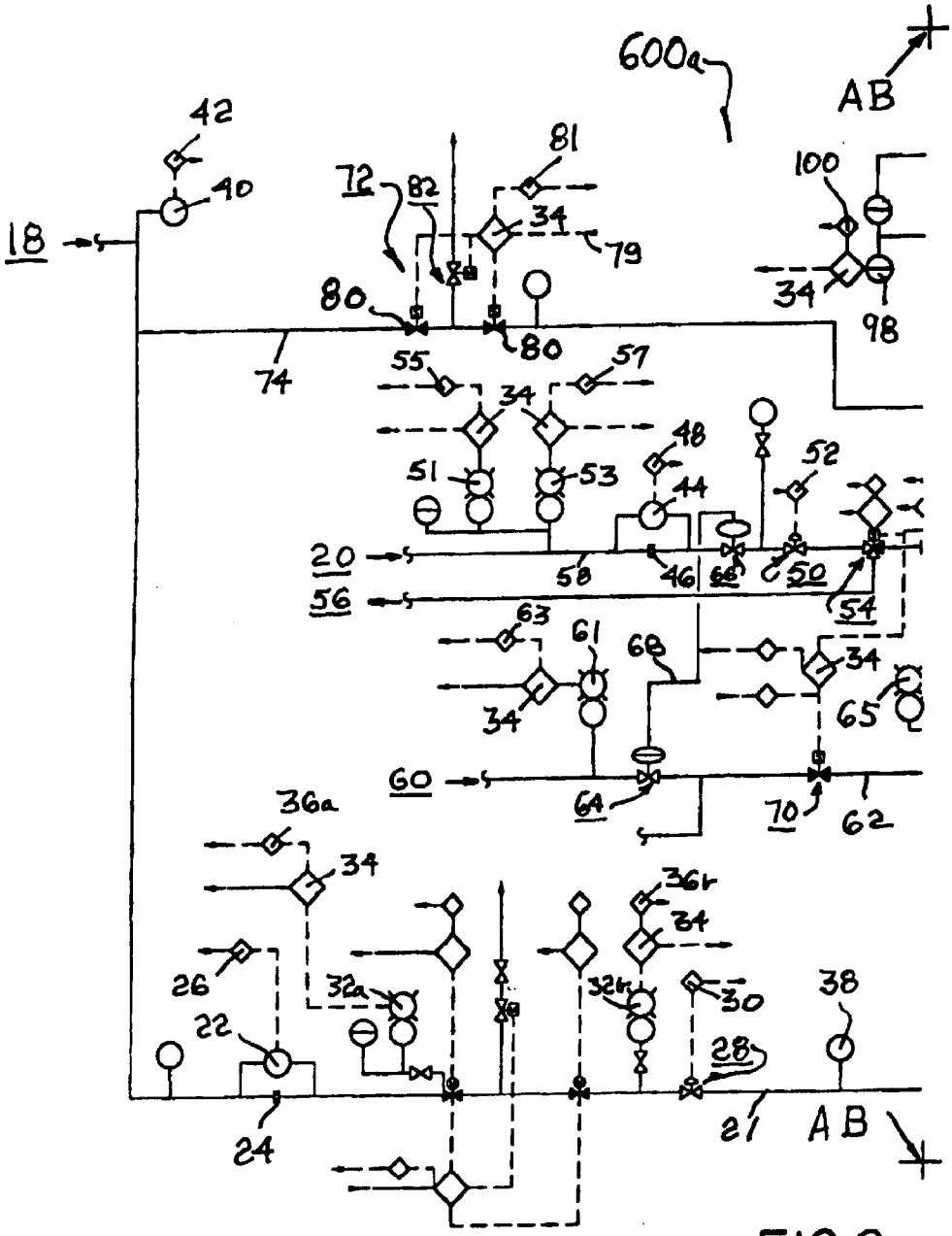
FIGS. 2*a*, 2*b*, and 2*c* are adjoining drawings of a materials and information flow schematic diagram (process operating system) for controlling a steam boiler in accordance with the invention.
Figure 2B:
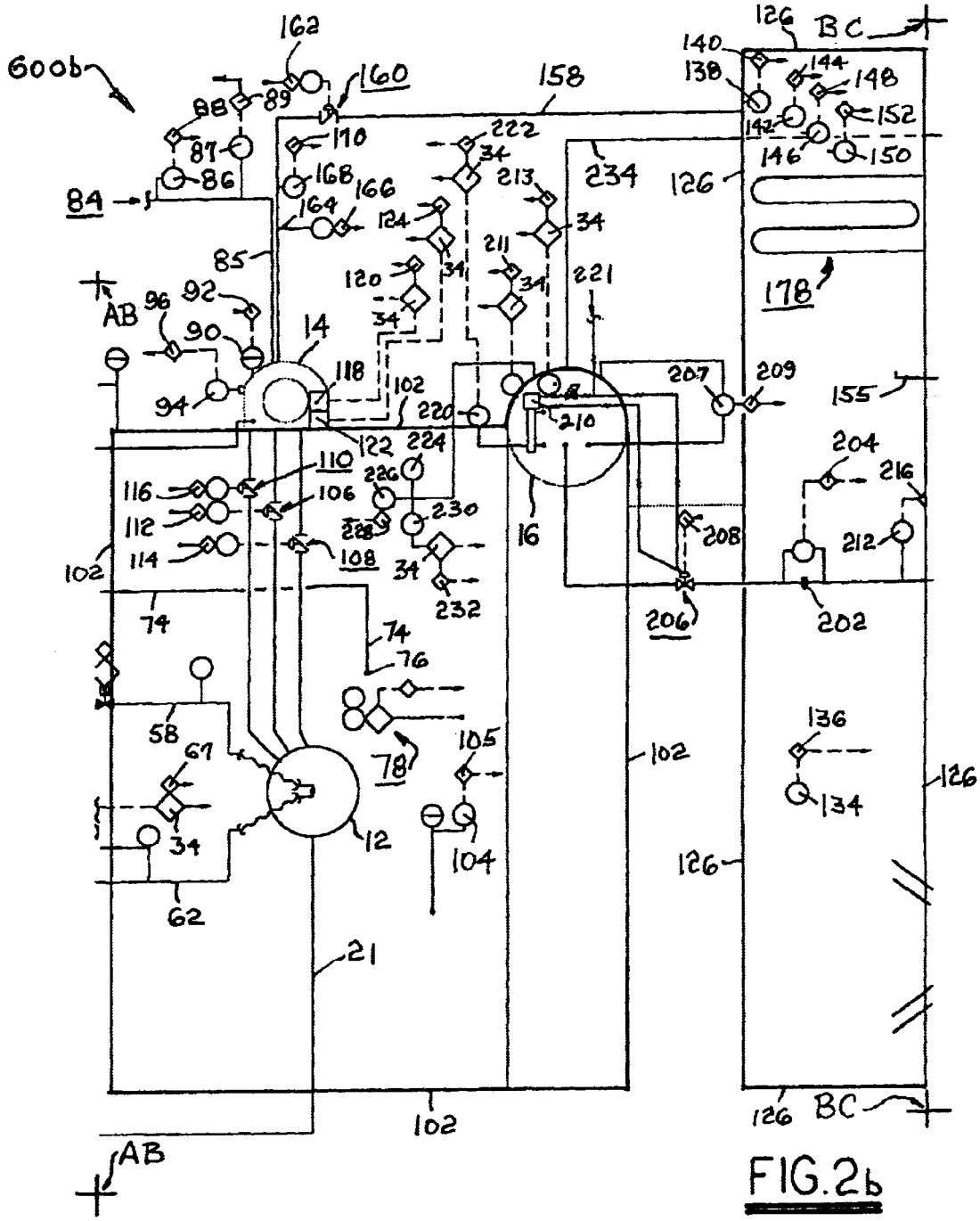
Figure 2C:
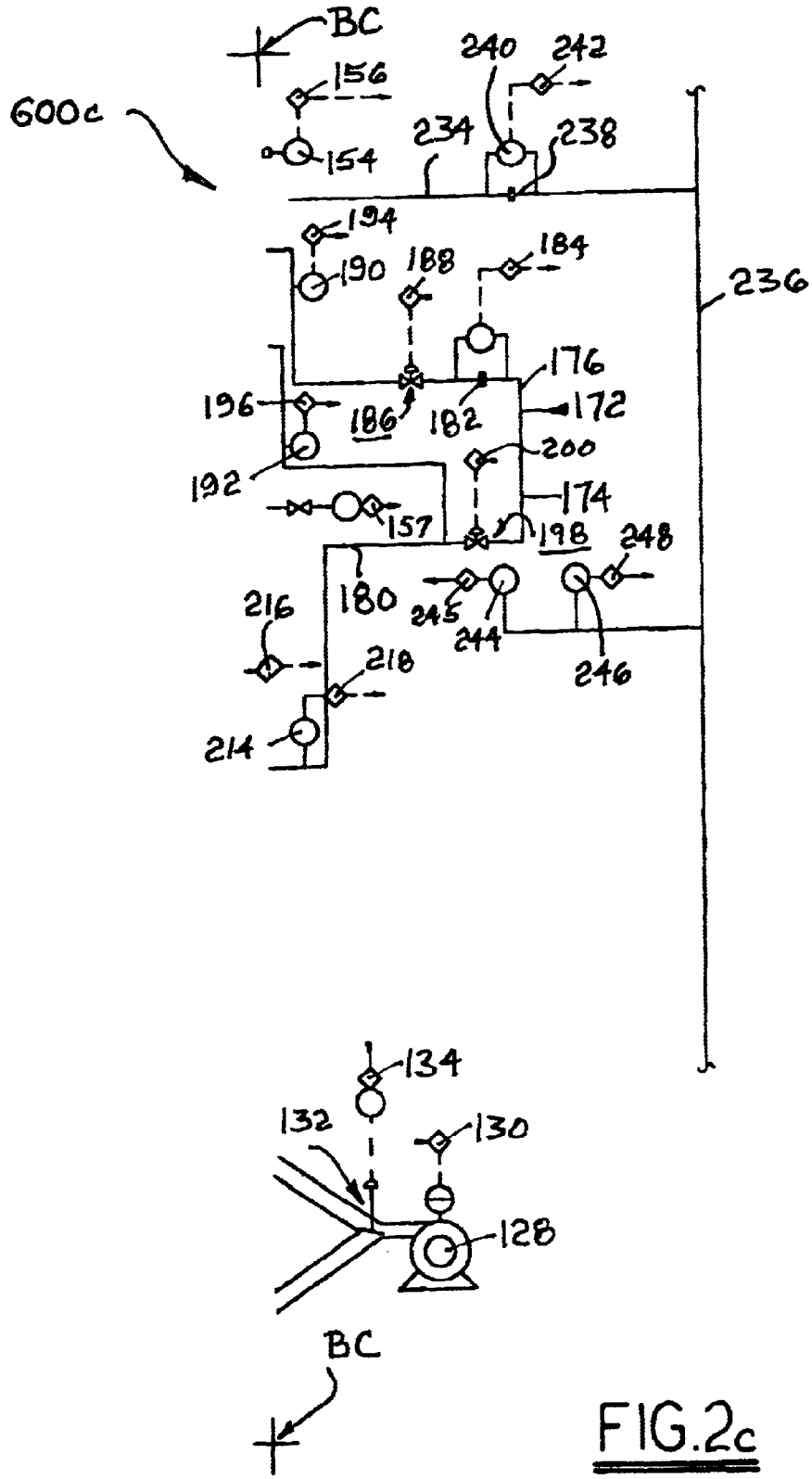

Referring to FIGS. 2*a*, 2*b*, and 2*c*, the three drawings should be understood to be joined at reference points AB and BC, respectively, and are equivalent to a single wide drawing, FIG. 2. It should be further understood that all logic preferably is controlled by PCS 500, which is omitted therefrom for clarity.

Process Operating Control diagrams 600*a*, 600*b*, 600*c* in accordance with the invention include burner 12, combustion air fan 14, and boiler drum 16. Burner 12 may be operated from either or both of a gas supply 18 and a fuel oil supply 20.

When burner 12 is fueled by gas, the rate of gas flow to burner 12 via line 21 is measured by pressure drop 22 across an orifice flowmeter 24, a flow signal 26 being sent to PCS 500. Gas flow is controlled by control valve 28 in response to an output signal 30 from PCS 500. Low fuel gas pressure is sensed by a pressure alarm switch 32*a* in the Burner Management System (BMS) 34 and signaled 36a to PCS 500. Preferably, an inline visual pressure gauge 38 is also provided. Similarly, high fuel gas pressure is sensed by pressure alarm switch 32*b* in BMS 34 and signaled 36*b* to PCS 500. Because the quality and composition of natural gas can vary considerably, affecting the volume of gas required for combustion, preferably the unit calorific heating value 40 of the incoming gas is determined and supplied 42 to PCS 500.

When burner 12 is on oil feed, oil flow rate is similarly controlled and monitored via pressure drop 44 across orifice flowmeter 46, a signal 48 being sent to PCS 500, and is controlled via control valve 50 in response to an output signal 52 from POS 600. High and low fuel oil pressure is alarmed 51, 53 and corresponding signals 55, 57 are sent to the PCS via BMS 34. Fuel oil may be recirculated via three-way solenoid valve 54 and return line 56 to prevent stagnation and sedimentation in feed line 58 when burner 12 is being fueled by gas or is shut down.

In a currently preferred mode of operation, the injection of oil into the burner and the combustion thereof is assisted by steam injection from a steam source 60 via line 62. The steam injection pressure is controlled by differential control valve 64 as a function of the oil feed pressure, as controlled by control valve 66 in oil feed line 58, the two valves being connected by line 68. Steam flow is controlled by a block valve 70 in response to BMS 34. A steam low pressure alarm 61 is signaled 63 to the PCS via BMS 34. In addition, a low aspiration pressure condition is alarmed 65 and signaled 67 to the PCS via BMS 34.

A pilot ignition system 72 for burner 12 draws gas from supply 18 via line 74 to an igniter 76 disposed adjacent burner 12. A flame detector system 78 confirms that the pilot is ignited in the burner. Gas flow is controlled by first and second valves 80 and signaled 81 to the PCS. BMS 34 communicates with detector system 78 via the PCS which signals 79 BMS 34 to vent pilot gas flow to atmosphere via valve 82 if ignition is not confirmed.

Combustion air fan 14 is supplied with air from an air source 84 via line 85. The temperature and absolute humidity of the incoming air is measured 86, 87 and sent 88, 89 to the PCS. The fan speed 90 is set by signal 92 from the PCS. The total air flow is measured 94 and a signal 96 sent to the PCS. Low output pressure from fan 14 is sensed 98 and a signal 100 sent to the PCS via BMS 34; likewise, pressure within windbox 102 is sensed 104 and also sent 105 to the PCS. Fan 14 provides primary, secondary, and trim air to burner 12, the flow of each being metered by electromechanical air dampers 106, 108, and 110, respectively, the positions of which are controlled by PCS outputs 112, 114, and 116, respectively.

Fan 14 is further provided with limit controls and alarms. BMS 34 determines that the blower motor starter control relay 118 is closed and relays a run contact signal 120 to the PCS. BMS 34 also determines whether the blower motor starter 122 is energized and relays a blower fault contact signal 124 to the PCS.

The exhaust from burner 12 discharges to atmosphere via boiler stack 126. Preferably, a supplementary eductor blower 128 discharges air into stack 126 to ensure positive flow therein. The speed of blower 128 is set via a signal 130 from the PCS; likewise, the position of an eductor damper 132 is set via a PCS signal 134. Within stack 126, several exhaust parameters are sensed and relayed to the PCS, including stack base temperature 134, 136, stack outlet temperature 138, 140, stack $NO_x$ 142, 144, stack $CO_2$ 146, 148, stack CO 150, 152, stack $O_2$ 154, 156. Stack exhaust velocity is sensed by a pitot tube 155 and sent 157 to the PCS. Measurement of additional stack parameters, while not specified herein, for example, stack $SO_x$ and stack VOC, are fully comprehended by the invention.

It is known in the art to recirculate a portion of the stack exhaust into the burner via the combustion air fan to modulate combustion and/or to burn residual hydrocarbons. In the present example, line 158 extends from boiler stack 126 to the inlet of fan 14 via flue gas recirculation damper 160. The position of damper 160 is set by a signal 162 from the PCS in response to a flue gas flow measurement made by pitot tube 164 and sent by signal 166 to the PCS. The temperature of the flue gas being passed into the fan is measured 168 and sent 170 to the PCS.

Boiler drum 16 is supplied with makeup water from a source 172. Water flow may be split between direct flow toward drum 16 via line 174 and an alternate flow via line 176 through a heat exchanger 178 disposed in boiler stack 126, wherein waste heat is used to preheat water going to the boiler, the two flows then being joined as line 180. Flow through heat exchanger 178 is measured by pressure drop across an orifice flowmeter 182, a flow signal 184 being sent to the PCS, and is regulated by a control valve 186 responsive to a signal 188 from the PCS. The inlet and outlet temperatures 190, 192 of water going through heat exchanger 178 are measured and respective signals 194, 196 sent to the PCS. Water bypassing heat exchanger 178 via line 174 is controlled by valve 198 in response to a signal 200 from the PCS. Total flow of makeup water into boiler 16 is measured by pressure drop across an orifice flowmeter 202, a flow signal 204 being sent to the PCS, and is regulated by a control valve 206 responsive to a signal 208 from the PCS to maintain a water level within the boiler. Differential sensor 207 provides a water level signal 209 to the PCS. Preferably, a redundant high/low level switch 210 in the boiler, requiring a pressurized instrument air supply 221, can also control valve 206 independent of the computer. Switch 210 also communicates high and low levels 211, 213 respectively with the PCS via BMS 34. Makeup water temperature and pressure are sensed 212, 214 and signaled 216, 218 respectively to the PCS. A low low sensor 220 monitors extreme low water level to prevent damage to the boiler in event of water flow failure and sends a signal 222 to the PCS via BMS 34. Drum pressure is shown visually on gauge 224 and is sensed by transducer 226 and sent 228 to the PCS. A high pressure safety switch 230 also communicates 232 via BMS 34 with the PCS if tripped.

Steam produced in boiler 16 is exhausted via steam line 234 into a main steam header 236. Steam flow into header 236 is measured via an orifice flowmeter 238, which flow value signal 240 is sent 242 to the PCS. Steam pressure in the header is sensed 244 and sent 245 to the PCS. Low pressure in header 236 trips low steam pressure contact 246 and sends a signal 248 to the PCS.

In a method for controlling the just-described boiler system, first the process is characterized by generating a characteristic multi-dimensional matrix, which may be displayed as a two-dimensional look-up table, by temporarily operating the process at all the possible factorial combinations of process input control variable settings, preferably from one extreme to the other for the settings of each input operator, and recording the resulting process output values of all the relevant process output parameters under each of the process operating combinations. Each input operator defines a dimension of the matrix. All input combinations which fail to operate the system, e.g., the burner fails to sustain a flame, are eliminated from the look-up table. Further, all input combinations which produce output parameter values outside the specified ranges are also eliminated from the look-up table. Thus, all input combinations remaining in the table will both operate the process and result in acceptable output values.

In the example shown in FIGS. 2*a*, 2*b*, 2*c*, the matrixed input operator signals are at least fuel oil flow 48 and/or gas flow 26, total air flow 96, primary air flow 112, secondary air flow 114, trim air flow 116, and flue gas recirculation air flow 166. Bias factors such as calorific heating value 42 of the fuel, air absolute humidity 89, flue recirculation gas temperature 170, makeup water flow 204, and makeup water temperature 218 may be applied. The measured and recorded output parameters are at least steam flow 242, steam pressure 248, stack outlet temperature 140, stack $NO_x$ 144, stack $Co_2$ 148, stack CO 152, stack $O_2$, drum pressure 228, and windbox pressure 105.

Preferably, each operator is varied in discrete steps from 0 to 100% of its operating range, and the output values recorded at each step. Preferably, each step is between about 1% and about 50% of the operating range. (Note that for on-off conditions, the operating range is considered to be a single step from 0% to 100%, with no steps in between.) The seven control operators just cited result in a seven-dimension matrix, which may be expressed, at least conceptually, as a very large spreadsheet or look-up table. Such a spreadsheet is readily accessible and searchable by a commercially-available computer If each operator is adjusted in, for example, 10% increments, then the resulting matrix has $10^7$ possible combinations, which may appear daunting to generate. However, along each matrix dimension when either the process becomes non-functional or one of the output parameters is out of range, the remainder of that dimension is not evaluated further. Thus, the actual table of values may become relatively small.

After building the characteristic look-up table, a method for operating the process in accordance with the invention is as follows.

First, a primary process output control parameter, preferably steam flow rate 242, is selected, and an aim value of that parameter is specified as a primary control setpoint for the process control system 500. For controlling a steam boiler system, steam flow rate 242 is preferred over steam pressure 248 as the flow rate provides much more sensitive feedback on the state of the process; flow rate may vary significantly before being reflected in a change in steam header pressure. Of course, the look-up table does not discriminate among output parameters, so in principle the process could be controlled equally well on any other such parameter if so desired. If several combinations of input operator settings in the look-up table can satisfy the primary control setpoint (aim value for steam flow 242), then a further selection among those combinations is performed according to an additional input criterion, such as minimum value of fuel flow 48 and/or 26, to arrive at the optimal combination of operator settings for control of the process.

After the best combination is selected, the operator mechanisms such as valves and dampers governing the input variables are driven, as by motors or other actuators, to those input settings. As noted above, in important contrast to a prior art start-up, all input control operators are set initially and immediately at the optimal or near-optimal input values selected from the look-up table, rather than beginning at random settings. Process control thus begins at or very near to the optimal settings. The prior art start-up, on the other hand, will eventually accept any combination of settings which provides the setpoint steam flow value, but with an extremely low probability that the in-control combination arrived at is also the optimum combination for fuel consumption.

Of course, in the present control method, the desired setpoint value may not correspond exactly to discrete input values in the table, in which case the correct input settings may be inferred by linear interpolation between adjacent bracketing settings for adjacent bracketing output values.

After the operator mechanisms are set at their nominal initial positions, the mechanisms are dynamically controlled in PCS 500 by output drive signals and input status signals in closed-loop control. Although a moderate level of process control may be exercized using conventional PID control from this point onward, it is highly preferable to employ an improved feedback control logic, as described below, using the desired primary output value (steam flow) as the controller input setpoint, preferably using a function of the process output and time to recalculate and adjust the drive signals to cause the process to come into control.

The improved process control logic is process rate time-delayed (PROcess+RAte+TIme+Delayed), referred to herein by the acronym PRORATID. An improved controller in accordance with the invention can adjust its output non-linearly by algorithm to compensate for the device which it is controlling. For example, if a valve does not open linearly with a linear change in electrical signal, the PRORATID controller can de-linearize its own output to make the valve it is controlling open so that the flow is linear with percent output. For example, for a valve having a non-linear flow function, the controller output is changed to inversely mimic the valve flow function, such that a 10% increase in the PRORATID control output will increase the flow in the pipe by 10%.

Further, a PRORATID controller can adjust its output speed to pace or match the output of any other device in the system, and especially the response rate of the slowest device. For example, if a first valve in the system can go from closed to open in 10 seconds, and a second valve requires 30 seconds, the output that controls the first valve will be slowed down so that the first and second valves change at the same rate (the rate of the second and slower valve), thus maintaining a constant ratio of flows through the two valves during flow transitions.

A steam boiler system thus operated and controlled will generate a specified flow of steam and will meet all of its other output objectives while using a minimum flow of fuel. After a prior art boiler system was converted to control in accordance with the method and apparatus of the invention, fuel savings of more than 20% were observed during subsequent operation.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. In a process having a plurality of input operators, each operator being independently variable over its own range of settings, and a plurality of process output parameters, each parameter having a range of acceptable values, a method for controlling the process such that a specified value for a primary process output parameter is achieved and all other process output parameter values are within their respective acceptability ranges, comprising the steps of:

a) characterizing said process to produce a look-up characteristic table by determining empirically the operational relationships between said plurality of input operators and said plurality of output parameter values for combinations of said input operator settings resulting both in operation of the process and in output parameter values within said ranges of acceptable values;

b) designating one of said process output parameters as a primary control parameter;

c) providing a desired value of said designated primary control parameter as a process control setpoint;

d) setting said input operators at a combination of respective settings as determined from said look-up table to cause said process to operate at a value of said designated control parameter approximating said process control setpoint.

2. A method in accordance with claim 1 wherein said table includes a plurality of such combinations of input operator settings that can cause said process to operate at a value of said designated control parameter approximating said process control setpoint, and wherein an optimal one of said plurality of settings is selected based upon a process input criterion.

3. A method in accordance with claim 2 wherein said process is selected from the group consisting of a steam boiler system and an oil heater system, said designated primary control parameter is selected from the group consisting of steam flow, steam pressure, and oil temperature, and said process input criterion is minimum fuel flow.

4. A method in accordance with claim 1 comprising the further step of engaging close-loop feedback control means for said input operators to cause said process to operate at an output value of said designated control parameter matching said process control setpoint value.

5. A method in accordance with claim 4 wherein said close-loop feedback control means includes a function of the process output and time to recalculate and adjust said drive signals to cause said process to come into control.

6. A method in accordance with claim 4 wherein said process control means includes a computer.

7. A method in accordance with claim 6 comprising the further step of calibrating said computer such that drive signals from said computer to said process operators produce a linear response in at least one of said operators.

8. A method in accordance with claim 6 comprising the further step of adjusting said drive signals from said computer such that the instantaneous rate of change for each process operator relative to its total range of operability is the same for all such operators.

9. A method in accordance with claim 8 comprising the further steps of:

a) forming a table of process response time delays to said drive signals for each of said input operators as a function of system operating percentage;

b) when sending a drive signal to an input operator, determining from said table what said response time delay will be; and c) waiting at least the length of said determined response time delay before sending another drive signal to said output operator, to minimize overshoot and oscillation of said process response.

10. A method in accordance with claim 6 comprising the further step of causing said computer to check said process input and output parameters continuously against a thermodynamic model to determine when a process failure occurs.

11. A method in accordance with claim 10 including the further step of using said computer to determine where in said process said failure has occurred.

12. A method in accordance with claim 1, comprising the further steps of:

a) determining from said table values of said designated control parameter closest to and bracketing said desired value;

b) determining the interpolated position of said desired value between said bracketing table values;

c) using said interpolated position to interpolate between bracketing settings of corresponding of said operator input settings from said table; and d) adjusting settings of said plurality of operators in accordance with said interpolations such that said process operates at said setpoint and values of all other of said output parameters are within their respective acceptability ranges.

13. A method in accordance with claim 1 wherein said characterizing step includes the steps of:

a) setting the positions of all input operators at predetermined limits of their operability ranges;

b) varying settings of a first of said operators in a plurality of discrete steps over its operability range while holding the settings of each of said other operators constant;

c) recording values of each of said output parameters at each of said discrete operator input settings;

d) changing the setting of a second of said input operators by a discrete step away from said operability limit;

e) repeating steps b) through d) in successive discrete steps until said second operator reaches the opposite limit of its predetermined operability range;

f) repeating steps d) and e) for each additional operator, whereby said characteristic multidimensional look-up table of operator input settings is created, as well as a database of parameter output values corresponding to each of said steps in said look-up table; and g) deleting from said look-up table all input settings which fail either to cause the process to operate or to provide output values within said ranges of acceptable values, resulting in an adjusted look-up table of input settings under which the process will operate and will provide output values within said ranges of acceptable values.

14. A method in accordance with claim 13 wherein each of said input operators is controlled by an electromechanical actuator responsive to drive signals from said feedback control means, and wherein each of said actuators is operable in discrete steps.

15. A method in accordance with claim 14 wherein a discrete step encompasses an operability range from zero percent to one hundred percent.

16. A method in accordance with claim 14 wherein each of said discrete steps encompasses between about one percent and about fifty percent of said operability range.

17. A method in accordance with claim 1 wherein said input operators are selected from the group consisting of fuel flow valve, primary air flow damper, secondary air flow damper, trim air damper, feedwater control valve, main air blower, exhaust damper, flue gas recirculation damper, steam atomization valve, eductor fan for exhaust stack, boiler nozzle positioner, and combinations thereof.

18. A method in accordance with claim 1 wherein said process output parameters are selected from the group consisting of steam flow, steam pressure, drum water level, primary blower speed, secondary air flow, trim air flow, combustion chamber pressure, exhaust carbon monoxide content, exhaust oxygen content, exhaust nitrogen oxides content, exhaust sulfur oxides content, exhaust gas flow, flue gas recirculation flow, input fuel stream BTU value, flame sensor, and exhaust temperature.

* * * * *